US005251401A

United States Patent [19]

Prete et al.

[11] Patent Number: 5,251,401

[45] Date of Patent: Oct. 12, 1993

[54] PIVOT CORNER FOR A SASH WINDOW

[75] Inventors: James G. Prete, Hinsdale, Ill.; James Sharp, Cedar Lake, Ind.

[73] Assignee: Ashland Products, Inc., Chicago, Ill.

[21] Appl. No.: 770,182

[22] Filed: Oct. 2, 1991

[51] Int. Cl.[5] ..... E05D 15/22

[52] U.S. Cl. ..... 49/181; 16/386

[58] Field of Search ..... 49/176, 181, 445, 446, 49/453; 16/193, 342, 386

[56] References Cited

U.S. PATENT DOCUMENTS

| | | | |
|---|---|---|---|
| 2,598,560 | 5/1952 | Kenyon | 16/193 |
| 3,068,508 | 12/1962 | Heyer | 16/386 |
| 3,222,733 | 12/1965 | Wahlfeld et al. | 49/181 |
| 3,434,236 | 3/1969 | Weidner et al. | 49/176 |
| 4,542,558 | 9/1985 | Brockhaus | 16/386 X |
| 4,566,408 | 3/1985 | Brown | 16/386 X |
| 4,683,676 | 8/1987 | Sterner | 49/181 |
| 4,718,194 | 1/1988 | FitzGibbon et al. | 49/181 |

*Primary Examiner*—Peter M. Cuomo
*Assistant Examiner*—Jerry Redman
*Attorney, Agent, or Firm*—Wallenstein, Wagner & Hattis, Ltd.

[57] ABSTRACT

A pivot corner adapted for operative engagement with a sash balance brake assembly of a pivotable sash window is disclosed. The pivot corner comprises a housing having an axial bore and a pivot pin. The pivot pin has a first portion disposed within the bore and a second portion extending outwardly therefrom and adapted for operative engagement with the brake assembly. The axial bore and the first pin portion are complementarily octagonal in cross-section. The first pin portion has a cross-section sufficiently smaller than the cross-section of the axial bore to permit non-destructive rotation of the pin relative to the housing upon application of a predetermined torque.

16 Claims, 2 Drawing Sheets

PIVOT CORNER FOR A SASH WINDOW

TECHNICAL FIELD

The invention relates to a pivotable sash window and, more particularly, to a flush-mounted pivot corner having a pivot pin extending from a housing and operatively engaged in a sash balance brake assembly, wherein the pivot pin rotates relative to the housing upon application of a torque greater than a predetermined amount.

BACKGROUND PRIOR ART

Double-hung window assemblies having pivotal sashes are well known in the art. Typically each of the sashes includes a pair of opposing pivot pins which outwardly extend into respective rotatable members in the side jambs. The rotatable members are each coupled to a sash balance assembly which provides an upward force to counteract, and thus balance, the gravitational force of the particular sash.

When pivoting the window, the center of gravity of the window is moved out of line with the force of the sash balance assembly, which can cause the sash balance assemblies to force the sash up. To counteract this force, the rotatable member often includes a rotatable brake assembly which locks the sash balance when the sash is pivoted. The brake assembly is typically actuated by rotation of the pivot pin when the sash is pivoted. Occasionally, the brake assembly jams and fails to rotate upon rotation of the pivot pin. When this happens, the pivot pin can twist and potentially break causing a catastrophic failure. Specifically, if the pivot pin breaks the sash can potentially fall out of the window frame.

The present invention is provided to solve this and other problems.

SUMMARY OF THE INVENTION

It is an object of the invention to provide a flush-mounted pivot corner adapted for operative engagement with a sash balance brake assembly of a pivotable sash window.

In accordance with the invention, the pivot corner comprises a housing and a pivot pin. The housing includes an axial bore. The pivot pin has a first pin portion disposed within the bore and a second pin portion extending outwardly therefrom and adapted for operative engagement with the brake assembly. The axial bore and the first pin portion are complementarily octagonal in cross-section. The first pin portion has a cross-section sufficiently smaller than the cross-section of the axial bore to permit non-destructive rotation of the pin relative to the housing upon application of a predetermined torque. Thus in the event the brake assembly jams and fails to rotate, the pin will rotate in the housing rather than twisting and breaking.

Other features and advantages of the invention will be apparent from the following specification taken in conjunction with the following drawing.

DETAILED DESCRIPTION

Figure 1:
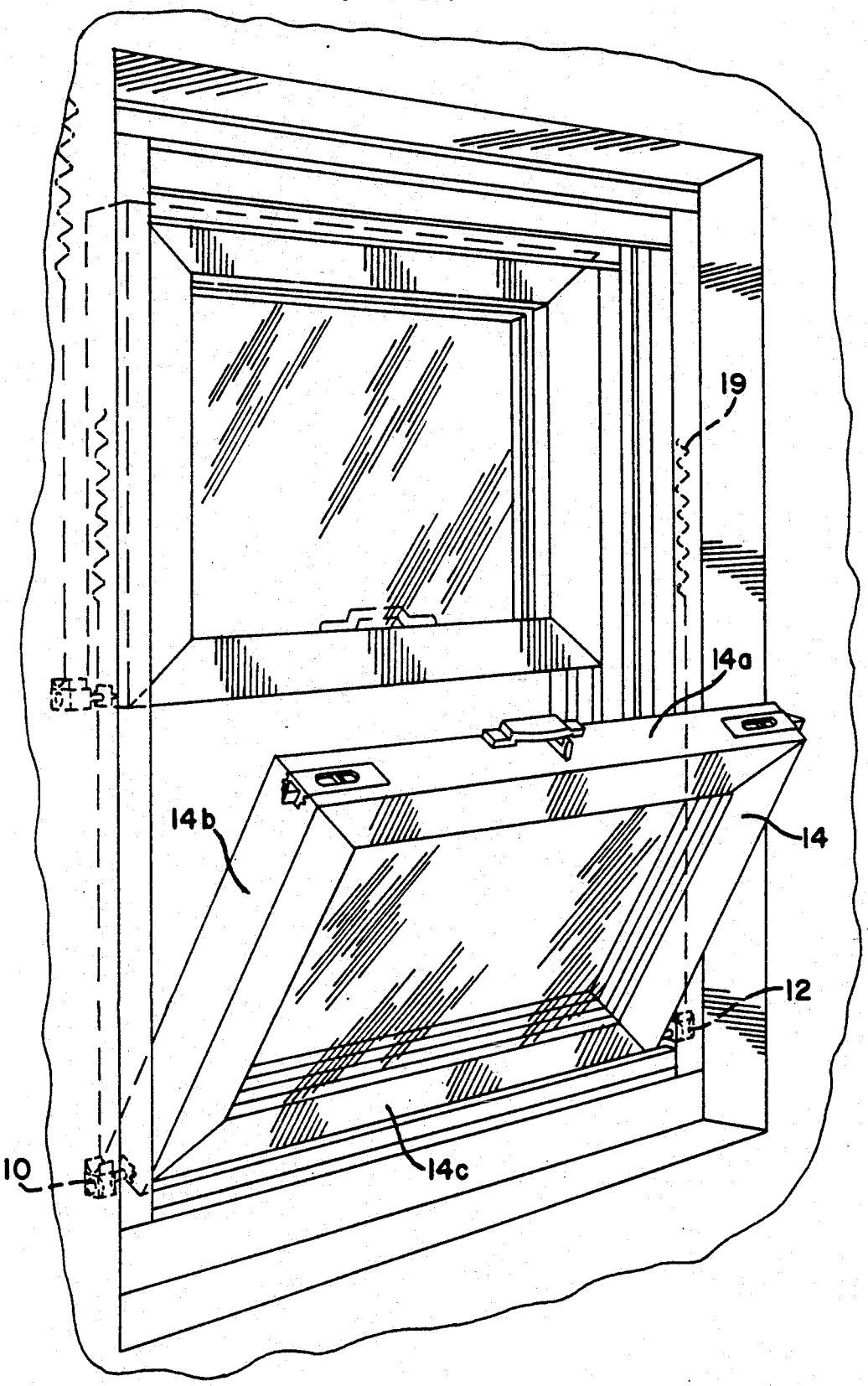
FIG. 1 is a perspective view of a double-hung window assembly including a pivot corner in accordance with the invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

A pivot corner, generally designated 10, adapted for operative engagement with a sash balance brake assembly 12 of a pivotable sash window 14 is illustrated in FIG. 1 The pivotable sash window 14 includes a top header 14*a*, two side stiles 14*b* and a base 14*c*.

Figure 2:
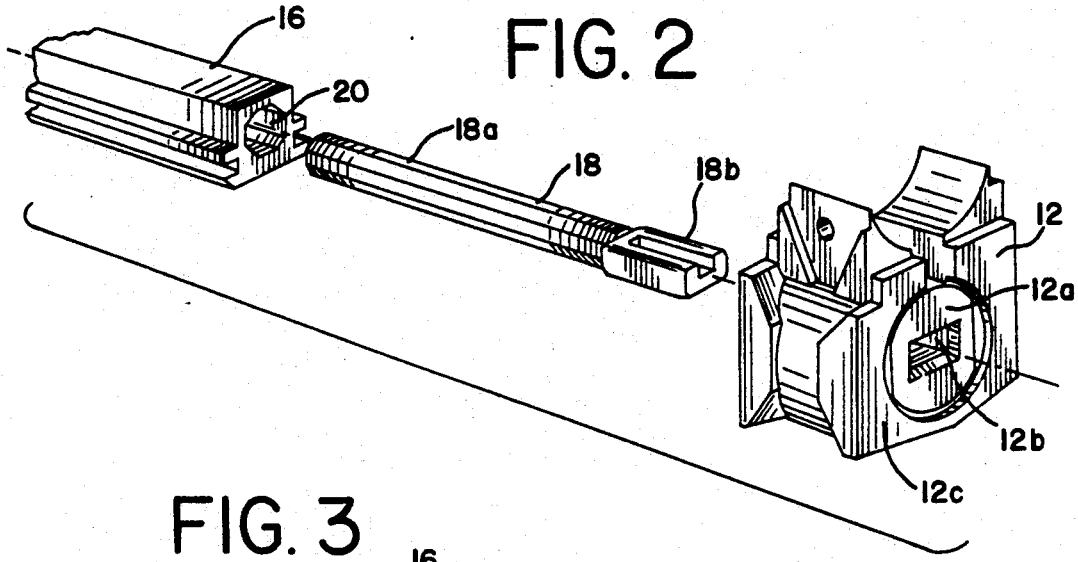
FIG. 2 is an exploded perspective view of the pivot corner and a brake assembly.
Figure 3:
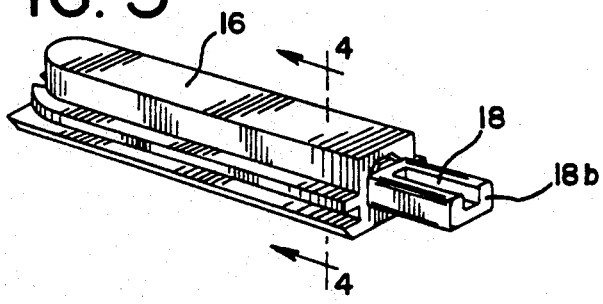
FIG. 3 is a perspective view of the pivot corner.

The pivot corner 10 is shown in greater detail in FIGS. 2 and 3. The pivot corner 10 comprises a housing 16 and a pivot pin 18. The housing 16 is molded of Nylon 6 and the pin 18 is molded of glass filled (30%) Nylon 6. The housing 16 is flush mounted along the bottom surface of the sash base 14*c*.

The housing 16 has an axial bore 20 having an octagonal cross-section. The pivot pin 18 has a first, octagonal portion 18*a* disposed within the bore 20 and a second, rectangular portion 18*b* extending outwardly therefrom.

The sash window 14 typically includes two of the brake assemblies 12, one installed in each of the side stiles 14*b*. A sash balance assembly, generally designated 19, is coupled to each of the brake assemblies 12.

The brake assembly 12 includes a generally oval drum 12*a* having a rectangular cavity 12*b* and rotatably disposed in a shoe 12*c*. As is well known, the drum 12*a* forms a camming surface with the inner surface of the shoe 12*c*, such that rotation of the drum 12*a* expands the shoe 12*c*. As is well known, expansion of the shoe 12*c* locks the brake assembly in the respective stiles 14*b*, locking the sash balance assembly in place.

The second rectangular portion 18*b* of the pin 18 is inserted into the rectangular cavity 12*b*. Thus when the sash 14 is pivoted, the housing 16 rotates the pin 18, which rotates the drum to cam open the shoe 12*c*.

Figure 4:
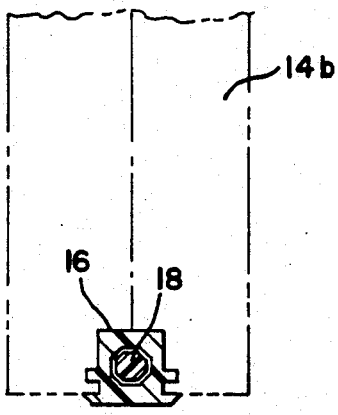
FIG. 4 is a section of the pivot corner taken along lines 4—4 of FIG. 3.
Figure 5:
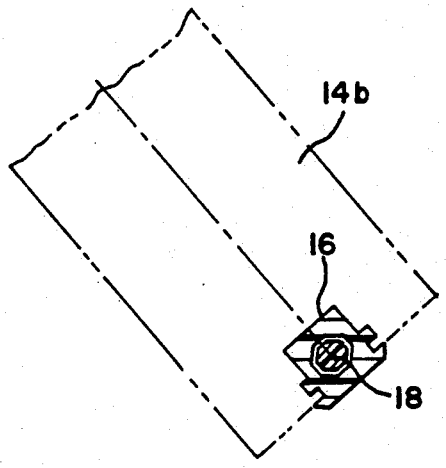
FIG. 5 is similar to FIG. 4, but with the sash window pivoted.

The octagonal first pin portion 18*a* has eight equal sides of 0.240". The octagonal bore 20 has four major sides of 0.270" and four minor sides of 0.250". Thus when the first octagonal portion of 18*a* of the pin 18 is inserted in the octagonal bore 20, there is an interference fit so that rotation of the housing 16 causes the pin 18 to rotate. However, if the drum 12*a* fails to rotate, the pin 18 will deform and, thereby, rotate in the housing 16, rather than twist and break, as illustrated in FIGS. 4 and 5. The brake assembly can be then repaired, the pin 18 can be reset properly in the bore 20, and the window assembly will be as good as new.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A pivot corner adapted for operative engagement with a brake assembly of a pivotable sash window, said pivot corner comprising:

a housing having an axial bore, said bore having a non-circular cross-section; and, a pivot pin having a first portion disposed within said bore and having a second portion extending outwardly therefrom and adapted for operative engagement with said brake assembly, said first portion having a cross-section substantially complementary to said bore to provide a limited rotary interference fit between said bore and said first pin portion, said limited interference fit permitting said pin to rotate relative to said bore upon application of a predetermined torque without breakage of said pin, and, said bore and said first pin portion being generally octagonal in cross-section.

2. In a pivot corner adapted for operative engagement with a brake assembly of a pivotable sash window, said pivot corner comprising a housing having a bore and a pivot pin, said bore having a non-circular cross-section, said pivot pin extending outwardly from said housing and adapted for operative engagement with said brake assembly, the improvement comprising means for permitting non-destructive rotation of said bore and said pin within said housing upon application of a predetermined torque upon said pin relative to said housing.

3. In a pivot corner adapted for operative engagement with a brake assembly of a pivotable sash window, said pivot corner comprising a housing having an axial bore and a pivot pin having a first pin portion disposed within said bore and a second pin portion extending outwardly from said axial bore and adapted for operative engagement with said brake assembly, the improvement comprising means for preventing destruction of said pin and said bore upon rotation of said pin within said housing upon application of a predetermined torque upon said pin relative to said housing.

4. In a pivot corner adapted for operative engagement with a brake assembly of a pivotable sash window, said pivot corner comprising a housing having an axial bore and a pivot pin having a first pin portion disposed within said bore and a second pin portion extending outwardly from said axial bore and adapted for operative engagement with said brake assembly, the improvement comprising means for permitting non-destructive rotation of said bore and said pin within said housing upon application of a predetermined torque upon said pin relative to said housing; and, said rotation permitting means comprising means for permitting rotation of said first pin portion relative to said housing upon application of said predetermined torque, said means for permitting rotation of said first pin portion further comprising said bore having a cross-sectional shape and said first pin portion having a complementary shape of sufficiently smaller diameter to permit said pin to rotate within said housing upon application of said predetermined torque, wherein said cross-sectional shapes are octagonal.

5. A pivot corner adapted for operative engagement with a sash balance brake assembly of a pivotable sash window, said sash window having an inwardly directed bore, said pivot corner comprising:

a pivot pin adapted for insertion into said bore and extending outwardly from said bore, said pivot pin adapted for operative engagement with said brake assembly; and means for permitting non-destructive rotation of said pin and said bore upon application of a predetermined torque on said pin.

6. A pivot corner system adapted for operative engagement with a brake assembly of a pivotable sash window, said pivot corner comprising:

an axial bore extending into said sash window, said bore having a non-circular cross-section; and a pivot pin having a first portion disposed within said bore and having a second portion extending outwardly therefrom and adapted for operative engagement with said brake assembly, said first portion having a cross-section substantially complementary to said bore to provide a limited rotary interference fit between said bore and said first pin portion, wherein said bore and said first pin portion are generally octagonal in cross-section.

7. A pivot corner adapted for operative engagement with a sash balance brake assembly of a pivotable sash window, said pivot corner comprising:

a housing having a longitudinal bore;

a pivot pin extending outwardly from said bore and adapted for operative engagement with said brake assembly; and means for preventing destruction of said pin and said bore upon rotation of said pin relative to said bore upon application of a predetermined torque on said pin relative to said housing.

8. A pivot corner adapted for operative engagement with a sash balance brake assembly of a pivotable sash window, said pivot corner comprising:

a housing having an axial bore, said bore having a non-circular cross-section;

a pivot pin having a first portion disposed within said bore and having a second portion extending outwardly therefrom, said pin being adapted for operative engagement with said brake assembly; and means for preventing destruction of said first pin portion and said bore upon application of any amount of torque on said second pin portion.

9. The pivot corner of claim 8 wherein said housing is flush with said window.

10. The pivot corner of claim 8 wherein said rotation preventing means comprises a limited interference fit between said first pin portion and said bore which prevents rotation of said first pin portion relative to said housing until application of said predetermined torque, said predetermined torque being less than an amount necessary to break said pin.

11. A pivot corner adapted for operative engagement with a pivotable sash window, said pivot corner comprising:

a housing having an axial bore, said bore having a non-circular cross-section;

a housing having an axial bore, said bore having a non-circular cross-section;

a pivot pin having a first portion rotatably secured within said bore and having a second portion extending outwardly therefrom; and means for preventing destruction of said first pin portion and said bore upon rotation of said first pin portion relative to said bore upon application of a predetermined torque to said second pin portion relative to said bore.

12. The pivot corner of claim 11 wherein said rotation permitting means comprises a limited interference fit between said first pin portion and said bore which slips upon application of said predetermined torque.

13. A pivot corner adapted for operative engagement with a brake assembly of a pivotable sash window, said pivot corner comprising:

a housing having an axial bore, said bore having a non-circular cross-section;

a pivot pin having a first portion disposed within said bore and having a second portion extending outwardly therefrom and adapted for operative engagement with said brake assembly, said first portion having a cross-section substantially complementary to said bore to provide a limited rotary interference fit between said bore and said first pin portion, said limited interference fit permitting said pin to rotate relative to said bore upon application of a predetermined torque without destruction of said pin and said bore.

14. A pivot corner adapted for operative engagement with a brake assembly of a pivotable sash window, said pivot corner comprising:

a housing having an axial bore, said bore having a non-circular cross-section;

a pivot pin having a first portion disposed within said bore and having a second portion extending outwardly therefrom and adapted for operative engagement with said brake assembly, said first portion having a cross-section substantially complementary to said bore to provide a limited rotary interference fit between said bore and said first pin portion, said limited interference fit permitting said pin to rotate relative to said bore upon application of a predetermined torque without destruction of said pin and said bore, wherein said bore and said first pin portion are generally octagonal in cross-section.

15. In a pivot corner system adapted for operative engagement with a brake assembly of a pivotable sash window, said pivot corner system comprising an axial bore extending into said sash window and a pivot pin, said pivot pin having a first pin portion disposed within said bore and a second pin portion extending outwardly from said bore and adapted for operative engagement with said brake assembly, the improvement comprising means for permitting rotation of said pin within said bore upon application of any torque greater than a predetermined torque without destruction of said pin and said bore.

16. In a pivot corner system adapted for operative engagement with a brake assembly of a pivotable sash window, said pivot corner system comprising an axial bore extending into said sash window and a pivot pin, said pivot pin having a first pin portion disposed within said bore and a second pin portion extending outwardly from said bore and adapted for operative engagement with said brake assembly, wherein each of said first pin portion and said bore have octagonal cross-sectional shapes, and further comprises means for permitting rotation of said pin within said bore upon application of any torque greater than a predetermined torque without destruction of said pin and said bore.

* * * * *